US008020667B2

(12) United States Patent
Johnson

(10) Patent No.: US 8,020,667 B2
(45) Date of Patent: Sep. 20, 2011

(54) LIFT APPARATUS

(76) Inventor: Dennis Johnson, Mooresville, NC (US)

( * ) Notice: Subject to any disclaimer, the term of this patent is extended or adjusted under 35 U.S.C. 154(b) by 1188 days.

(21) Appl. No.: 11/788,557

(22) Filed: Apr. 19, 2007

(65) Prior Publication Data

US 2007/0249280 A1 Oct. 25, 2007

Related U.S. Application Data

(63) Continuation of application No. PCT/US2007/009822, filed on Apr. 20, 2007.

(60) Provisional application No. 60/793,983, filed on Apr. 21, 2006.

(51) Int. Cl.
*B66B 9/16* (2006.01)

(52) U.S. Cl. ..... 187/240; 187/391; 414/592

(58) Field of Classification Search ..... 187/201, 187/203, 239, 240–244, 247, 277, 391, 401, 187/900; 182/70, 77, 88, 101, 141, 142; 244/137.1, 137.2, 137.4; 414/283, 422, 425, 414/501, 505, 558, 564, 592, 598, 612, 632, 414/665, 666, 669, 670
See application file for complete search history.

(56) References Cited

U.S. PATENT DOCUMENTS

| | | | | | |
|---|---|---|---|---|---|
| 1,811,709 | A | | 6/1931 | Bessler | |
| 3,363,790 | A | * | 1/1968 | Nelson | 414/501 |
| 3,478,904 | A | | 11/1969 | Courter | 214/75 |
| 3,606,039 | A | * | 9/1971 | Arnott et al. | 414/283 |
| 3,763,964 | A | * | 10/1973 | Davis | 187/239 |
| 3,776,492 | A | * | 12/1973 | Iben | 244/137.1 |
| 3,789,955 | A | | 2/1974 | Knapp | 182/78 |
| 3,791,541 | A | * | 2/1974 | Himes | 414/545 |
| 3,861,542 | A | | 1/1975 | Molter et al. | 214/75 G |
| 3,951,236 | A | * | 4/1976 | Schreiber et al. | 187/241 |
| 3,952,974 | A | | 4/1976 | Lang | 244/137 R |
| 4,176,732 | A | * | 12/1979 | Nordskog | 187/244 |
| 4,579,503 | A | * | 4/1986 | Disque | 414/558 |
| 4,586,684 | A | | 5/1986 | Carter et al. | 244/137 R |
| 5,076,515 | A | | 12/1991 | Goon | 244/137.1 |
| 5,122,026 | A | * | 6/1992 | Kent | 414/545 |
| 5,263,808 | A | * | 11/1993 | Kent | 414/545 |
| 5,450,929 | A | * | 9/1995 | Ohgita et al. | 187/244 |
| 5,535,852 | A | | 7/1996 | Bishop et al. | 187/336 |
| 5,626,208 | A | | 5/1997 | Sprague et al. | 187/267 |
| 5,667,035 | A | | 9/1997 | Hughes | 182/142 |
| 6,866,118 | B1 | | 3/2005 | Battenberg | 182/77 |
| 6,962,236 | B2 | | 11/2005 | Penn | 182/77 |
| 2006/0000675 | A1 | | 1/2006 | Penn et al. | 182/142 |

* cited by examiner

*Primary Examiner* — Jonathan Salata
(74) *Attorney, Agent, or Firm* — Michael E. Mauney

(57) ABSTRACT

A lift apparatus to deploy from a storage position in a ceiling to a working position supported by the floor of a room below the ceiling where the lift apparatus is stored. A electrically motor powered drive raises a lift platform and lowers a lift platform to carry items from the room to an attic above the room. Controls are used to deploy the lift apparatus and to operate the lift platform on the lift apparatus. Preferred method of operating the lift apparatus is an acme screw drive which provides an appropriate mechanical advantage reducing the size of the motor required, but also will prevent downward movement either of the lift apparatus during the deployment procedure or of the lift platform while moving items from the attic to the room below the attic or from the room below the attic to the attic. The lift apparatus is supported by the floor and does not require any special bracing or strengthening of floor joists. When stored it is completely out of view of the living area of the room below the ceiling where the apparatus is stored.

18 Claims, 5 Drawing Sheets

FIG. 5
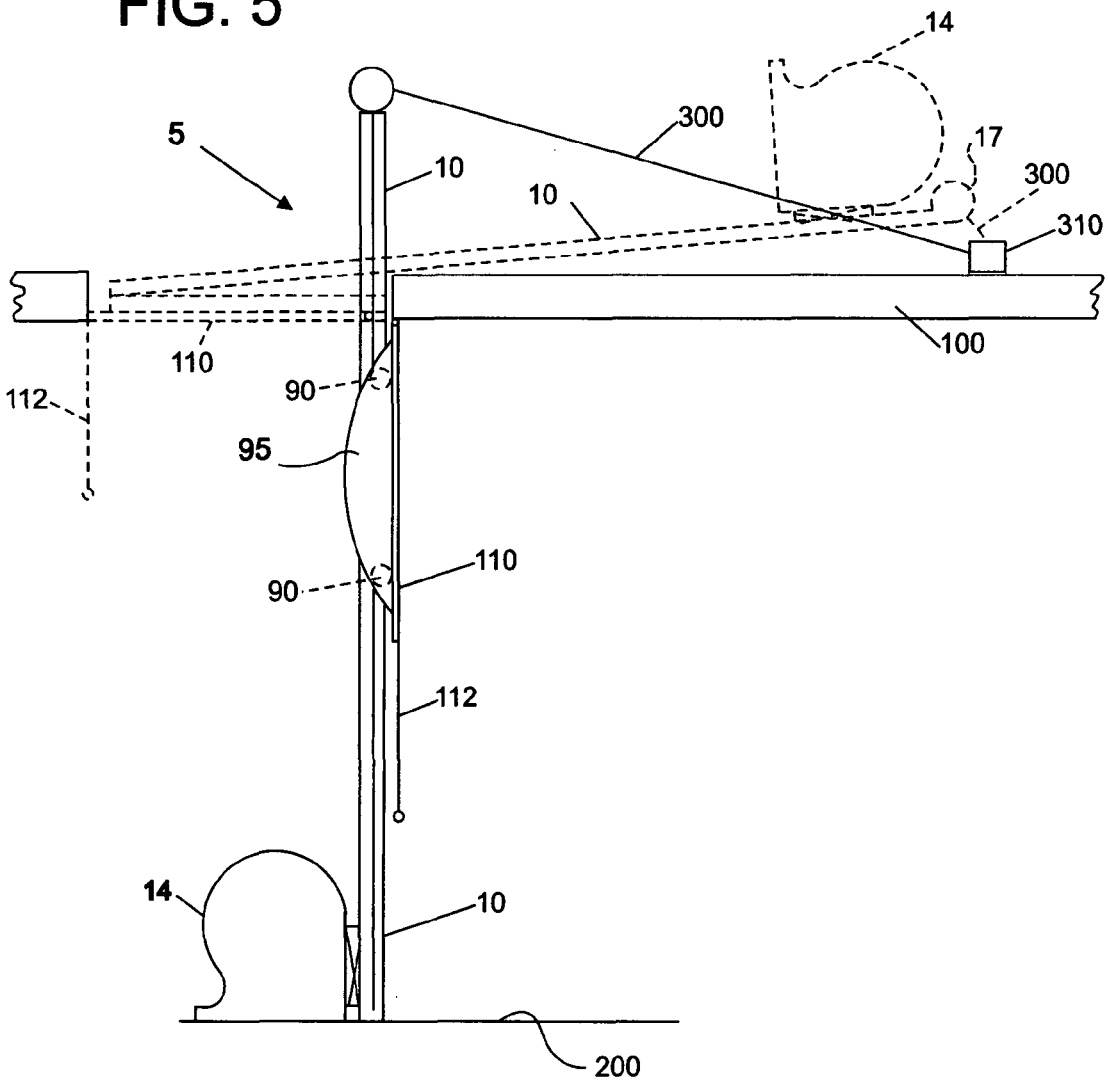
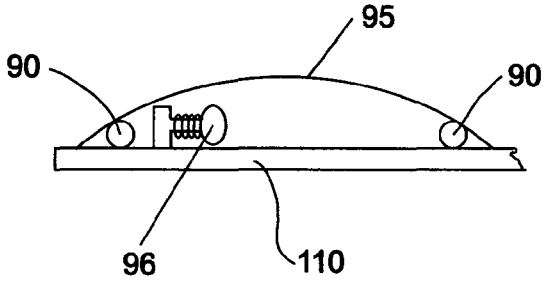
FIG. 5A

LIFT APPARATUS

RELATED APPLICATION

This application claims benefit of a provisional application Ser. No. 60/793,983, with a filing date of 21 Apr. 2006 and is a Continuation of copending PCT International Application PCT/US07/09822 filed on Apr. 20, 2007.

FIELD OF THE INVENTION

This invention related generally to a lift apparatus for raising or lowering objects from one floor in a building to another floor in a building. More specifically, it relates to an apparatus when not in use is stored in the attic and can be deployed to the floor of the room below the attic to move objects from the floor below to the attic or to move objects from the attic to the room below.

BACKGROUND OF THE INVENTION

Many buildings are built with space between the roof of the building and the living or working areas below the roof. Most houses have a peaked roof but a flat ceiling in the room or rooms directly below the roof. This creates an area between the roof and the ceiling of the room situated below that part of the roof, which is usually called an "attic." Attics are sometimes used for storage of objects. Moreover, access must be provided from the living or working areas of a building to the attic in the event of a need to make repairs, to check on electrical wiring or heating and air conditioning ducts, and so on. Consequently, there is ordinarily some means of access provided for a user of a building to this attic space.

For most homes and garages, the most common access to the attic storage area consists of an opening in a ceiling. The opening is usually concealed by a trap door apparatus. Built into the trap door is a folding ladder. Therefore, to gain access to the attic, the trap door is pulled down, usually by a chain or a rope, which allows one access to the folded ladder. The ladder is unfolded with the bottom of the ladder now resting on the floor of the room below the trap door in the opening in the ceiling. One may then walk up the ladder through the opening into the attic area. The trap door is usually closed by a spring loaded hinge, which holds the trap door into the closed position until someone pulls on the chain or the rope that extends from the trap door into the from below. There are many disadvantages to this system. First, many people find a rope or chain hanging in to a living area to be unsightly. Second, the ladder is often narrow with rungs of no more than two or three inches in width. Third, the angle formed by the ladder and the floor on which it rests is usually much steeper than is the case for stairwells. Consequently, using the ladder means balancing one's feet on narrow rungs on a narrow ladder that is steeply angled to the floor on which the ladder rests. This makes it difficult to safely carry boxes of any size or weight from the living area into the attic area. Consequently, most attics are used for storage of such relatively light items as Christmas decorations, seasonal items, small boxes of clothes, empty luggage and other light weight items. Attics are rarely used for storage of substantial items such as household furniture, appliances, televisions, or other large or heavy items. The attic area is useable only by people who are capable of using a narrow, steep ladder. This excludes almost anyone with balance problems, people with bad knees, or people who have difficulty negotiating stairs.

A variety of expedients have been proposed as an alternative to the folding stairs. The most common expedient employs a framework attached to wood joists that may form a part of the ceiling of the room above the ceiling opening to the attic area. Mounted on this framework is a winch and cable drum attached at four corners to a lift platform. The winch can then be employed to raise or lower the lift platform. Once example of this type of device is seen in Bishop et al., U.S. Pat. No. 5,535,852. Here, a framework is built and mounted on a bracket to ceiling joists. There is a winch, employed at the top of the framework. A telescoping frame is also mounted to allow this telescoping frame to extend from the attic into the room below. The weight of any objects carried in the lift basket is supported by the ceiling joists on which the framework is mounted. A similar device is seen in Hughes, U.S. Pat. No. 5,667,035. Again, there are telescoping legs which extend from the ceiling into the area in the room below the ceiling. A lift platform is raised and lowered by a series of pulley mounted cables which attach to a winch. Penn, U.S. Pat. No. 6,962,236 employs a slidable, moveable frame, which may be slid away from the ceiling opening. Used in conjunction with the slidable, moveable frame is a foldable ladder which extends to the floor from the ceiling opening. When the framework is slid out of the way, the ladder may be used in the conventional fashion. However, when the framework is slid over the ceiling opening, a winch is used to raise and lower a lift platform mounted on slots along the now unfolded ladder. Again, the weight of the lift platform and any contents are supported by cables affixed to the moveable lift platform. The cables are raised and lowered by an electric winch. Sprague et al., U.S. Pat. No. 5,626,208 proposes a permanently mounted device for using a structure for moving objects between adjacent floors. There is a rail which extends from one floor through the ceiling into the adjacent area above. A worm gear is used to raise and lower a lift platform, which is mounted on the railing. The worm gear is turned by an electric motor. When not in use, the lift platform is ordinarily kept in the ceiling above the room in which the guide rail is mounted. This closes off the ceiling opening and prevents any inadvertent falls through the ceiling opening and also closes off what would otherwise be an unsightly hole in the ceiling.

Other devices have been proposed to raise and lower cargo into a storage area within an airplane. Courter, U.S. Pat. No. 3,478,904 proposes a folding device with a moveable lift platform mounted for slidable movement on the folding rails of the device. The lift platform is raised and lowered by cable winches mounted within the airplane. A somewhat similar device is seen in Molter et al., U.S. Pat. No. 3,861,542. The device folds into and deploys from a cargo bay in an airplane. Within the device is a cable-like device to raise and lower a platform on which a cargo container may be placed when the cargo container is in position to be moved into the airplane itself. The device hangs from the side of the airplane and is supported by the airplane structure. Similar type devices seen for cargo handling in airplanes are seen in Lang, U.S. Pat. No. 3,952,974, Carter et al., U.S. Pat. No. 4,586,684, and Goon, U.S. Pat. No. 5,076,515.

Despite these efforts there is still an unmet need for a device to make accessible an area between a roof and a ceiling. The device should operate automatically and provide for a powered lift of people and/or goods from one area to another. The device should be usable for existing homes with a trap door in the ceiling and should be usable in new construction. It should be built with a fail-safe safety feature so that should power fail or a part of the device break, it will not result in a sudden drop of goods or a person from the ceiling to the floor. It should require no physical effort to open, operate, utilize, or close. It should place no operating weight on the ceiling. When not in use, it should occupy no residential floor space nor should it be a permanent part of the residential area. It should meet existing building code requirements and existing safety codes. It should be useable by people with physical handicaps or with an inability to use prior art folding ladders.

SUMMARY OF THE INVENTION

The invention consists of a rigid rail. One end of the rail is in proximity to a trap door which rotates for opening into the room below the attic floor on which the rigid rail is mounted. The rail is mounted for slidable movement into the opening created by the trap door in the ceiling. At the end of the rail opposite from the trap door, there is a lift platform of a size and shape to allow it to fit through the opening created by the trap door in the ceiling of the room below the attic in which the rigid rail is mounted. The rail is mounted for slidable rotatable movement. As the trap door begins to open, the rail is slid into the opening created by the trap door and will begin to move along the line of the now opening trap door. As it does so, the end of the rigid rail mounted in proximity to the door begins to extend into the room below. As it begins to extend into the room below, the rigid rail begins to tilt off a horizontal orientation toward a vertical orientation. As the trap door continues to open from a horizontal orientation toward a vertical orientation, the rigid rail continues its movement into the room below. As the angle of the trap door moves toward the vertical, so does the rigid rail. When the door is fully open and in a vertical orientation perpendicular to the floor below, the rigid rail now assumes a largely vertical orientation perpendicular to the floor below. The end of the rigid rail, which was mounted in proximity to the trap door, now extends to and rests upon the floor of the room below. The weight of the rigid rail and of the lift platform is supported by the floor. The lift platform can now be lowered to the floor with the weight of the lift platform supported by the floor by the floor end of the rigid rail. The lift platform can be raised and lowered by a number of expedients, including cables or a screw drive or worm gear. At the end of the rigid rail still now inside the attic, there will be at least one electric motor with appropriate gears, pulleys, and drives to raise and lower the lift platform. The electric motor can be used to raise and lower the lift platform from the floor of the room below into the attic space. Because the lift platform is mounted on a rigid rail, it is easy to maintain at a vertical orientation. The lift platform can move at a comfortable speed for someone standing in the lift platform. It can be designed to move several hundreds of pounds of boxes or items using the electric motor. The electric motor can be controlled by a remote device. A person can stand on the lift platform as it goes up and down or a person can remain on the floor below the lift platform while a second person remains in the attic. This maximizes the amount of weight that can be moved on the lift platform from the room below to the attic. The ceiling opening and the lift platform can be used to move relatively large items, such as chairs, appliances, televisions, and the like. It could be used in conjunction with hand carts or other devices to move relatively heavy bulky items. The lift apparatus itself may be made of appropriate lightweight aluminum or other materials so that the lift apparatus can be mounted on standard ceiling joists without the necessity of providing any extra bracing for support. The rigid rail rests on the floor which supports the lift rail and the weight of items moved during the operation of the lift apparatus. This means that the lift apparatus can be installed to existing homes without making any substantial modifications either to the ceiling area where the apparatus is mounted or to the floor where the rigid rail would be supported during use.

BRIEF DESCRIPTION OF THE DRAWINGS

FIG. 5 shows a second alternative embodiment of the current invention.

FIG. 5A is a detail view of a portion of the second alternative embodiment.

DETAILED DESCRIPTION OF THE DRAWINGS

Figure 1:
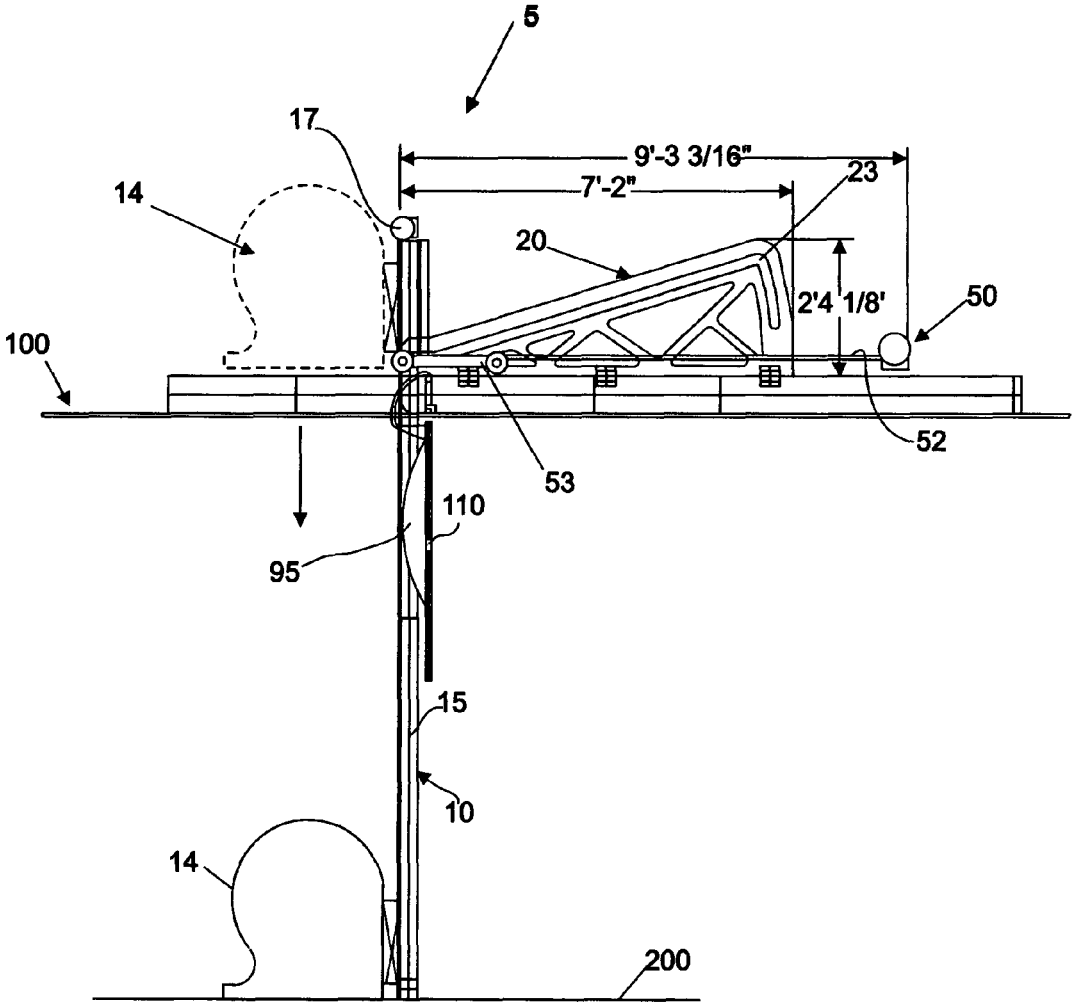
FIG. 1 shows in partial cross section a side view of an embodiment of the current invention extended for use.

FIG. 1 shows an embodiment of the lift apparatus (5) seen from the side in partial cut-a-way. Here the lift apparatus (5) is shown in an extended position ready for use. When not in use, the lift apparatus (5) is mounted above and on the ceiling (100). The lift apparatus (5) has several major mechanical parts. First, is a lift rail (10) shown in the vertical position ready for use. The lift rail (10) is extended and resting on the floor (200). At the floor end of the lift rail (10), ordinarily there will be some sort of special mounting bumper. This bumper will serve both to stabilize the lift rail (10) when resting on the floor and to distribute the weight of the lift rail and of its load in the platform (14) when in use. The bumper will be of a standard design. No particular bumper design is shown in FIG. 1. In the embodiment shown, the space between the floor (200) and the ceiling (100) is 10 feet. It will readily appreciated that the lift apparatus (5) could be adopted to different sized ceilings. In FIG. 1, exemplar dimensions are shown in order to give a better idea of the dimensions required for a practical embodiment the lift apparatus (5). Shown in proximity to the floor (200) is a lift platform (14) in solid lines. The lift platform (14) is mounted for longitudinal movement on the lift rail (10). Once the lift rail (10) is deployed to the floor, the platform (14) (shown in dotted lines in FIG. 1) will move from its storage position at the lift rail motor (17) end of the lift rail (10), in the direction shown by the arrow, to the point the lift platform (14) is in proximity to the floor (200). An acme screw (15) translates a rotational movement provided by the lift rail motor (17) into linear motion of the lift platform (14). A screw drive of some kind is a preferred means of raising and lowering the lift platform (14). First, a screw drive provides a mechanical advantage, thus reducing the size and torque required of the lift rail motor (17). Also, appropriately designing an acme screw drive (15) provides a self-locking function. The self-locking function is achieved by selecting a nut (not shown) to ride on the acme screw drive (15) with an efficiency below 35%. It is believed that a higher efficiency is not required since the lift platform (14) is expected to move relatively slowly from the position on the floor (200) (as shown) until it is raised to the ceiling 10 feet above as shown by the lift platform (14) shown in dotted lines. The relatively slow linear movement of the lift platform (14) along the acme screw drive (15) reassures a user and also avoids problems associated with a higher efficiency nut such as back driving. The lift rail motor (17) will ordinarily be operated by a radio actuated remote control (not shown) which will turn the lift rail motor (17) on and off and to control the direction it drives the acme screw drive (15) to raise or lower the lift platform (14). As will be shown in more detail in other drawings, the lift rail (10) mounts on at least one positioning guide (20). For security, ordinarily, there will be a matching positioning guide (20) mounted on the other side of the lift rail (10) but is not seen in this view. The positioning guide (20) has a positioning slot (23). At an appropriate point on the lift rail (10) guide rollers (19) (seen in FIG. 2) are mounted within the positioning slot (23). The positioning motor (50) uses a positioning acme drive (52). The positioning acme drive (52) rotates. As the positioning acme screw rotates it moves a nut (not shown) along the positioning acme drive (52). The acme drive (52) may rotate in one direction or reverse to rotate in the other direction to move the screw longitudinally along the length of the positioning acme drive (52). Rotationally mounted on the nut is a control arm (53). One end of the control arm (53) is positioned within the positioning slot (23) and attached to the lift rail (10). Consequently, as the positioning acme drive (52) rotates, it moves the control arm (53) along the acme drive (52). The control arm (53) either pulls or pushes the lift rail (10) as it slides along the positioning slot (23) in the positioning guide (20). A lift control trolley (95) may be mounted on the trap door (110). This will be explained in more detail in other drawings. The lift control trolley (95) may provide a guide for deployment of the lift rail (10). The lift control trolley (95) may also use controlled rotation bearings (90) to further assure a safe deployment of the lift rail (10) from the storage position above the floor to a fully deployed use position, as seen in FIG. 1, where the lift rail (10) is supported by the floor (200). Because the positioning acme drive (52) itself provides a "fail-safe" deployment of the lift rail (10) and because the positioning guide (20) also provides stability for the lift rail (10) during deployment, it is not anticipated that a lift control trolley (95) may be used where the positioning acme drive (52) is employed. However, the lift control trolley (95) does provide an extra element of safety and control for the lift rail (10). Consequently, the lift control trolley (95) is shown in FIG. 1 deployed on the trap door (110). The positioning of the lift rail (10) from a resting position in the ceiling (100) to an in-use position on the floor (200) will be shown in more detail in other drawings. The positioning guide (20), guide rollers (19), positioning acme drive (52), and positioning motor (50) assures that the lift rail (10) will be safely raised and lowered into position. The addition of a second acme drive such as the positioning acme drive (52) along with a second motor such as the positioning motor (50) adds to the overall expense of the lift apparatus (6) and it is possible as will be seen in later drawings, to provide for safe and efficient deployment of the lift rail (10) without the additional expense of the positioning acme drive (52) and the positioning motor (50).

FIG. 1 shows illustrative dimensions in English units. The ceiling to floor height is 10 feet (3.05 meters). The overall height of the lift rail is 13 feet (3.96 meters). The ceiling door (110) is four feet, six inches (1.37 meters). The positioning guide (20) is seven feet, two inches (2.18 meters) in length while it is two feet four and one-eighth inches in height (0.714 meters). The total length of the positioning acme drive (52) along with the positioning motor (50) is nine feet, three and three-sixteenths inches (2.82 meters). These dimensions are necessarily conformed for the ceiling height of 10 feet (3.05 meters). A different ceiling height will necessarily result in different dimensions but in approximate proportion to the difference between the 10-foot (3.05 meters) ceiling height shown here and a different ceiling height as might be used for another application.

Figure 2:
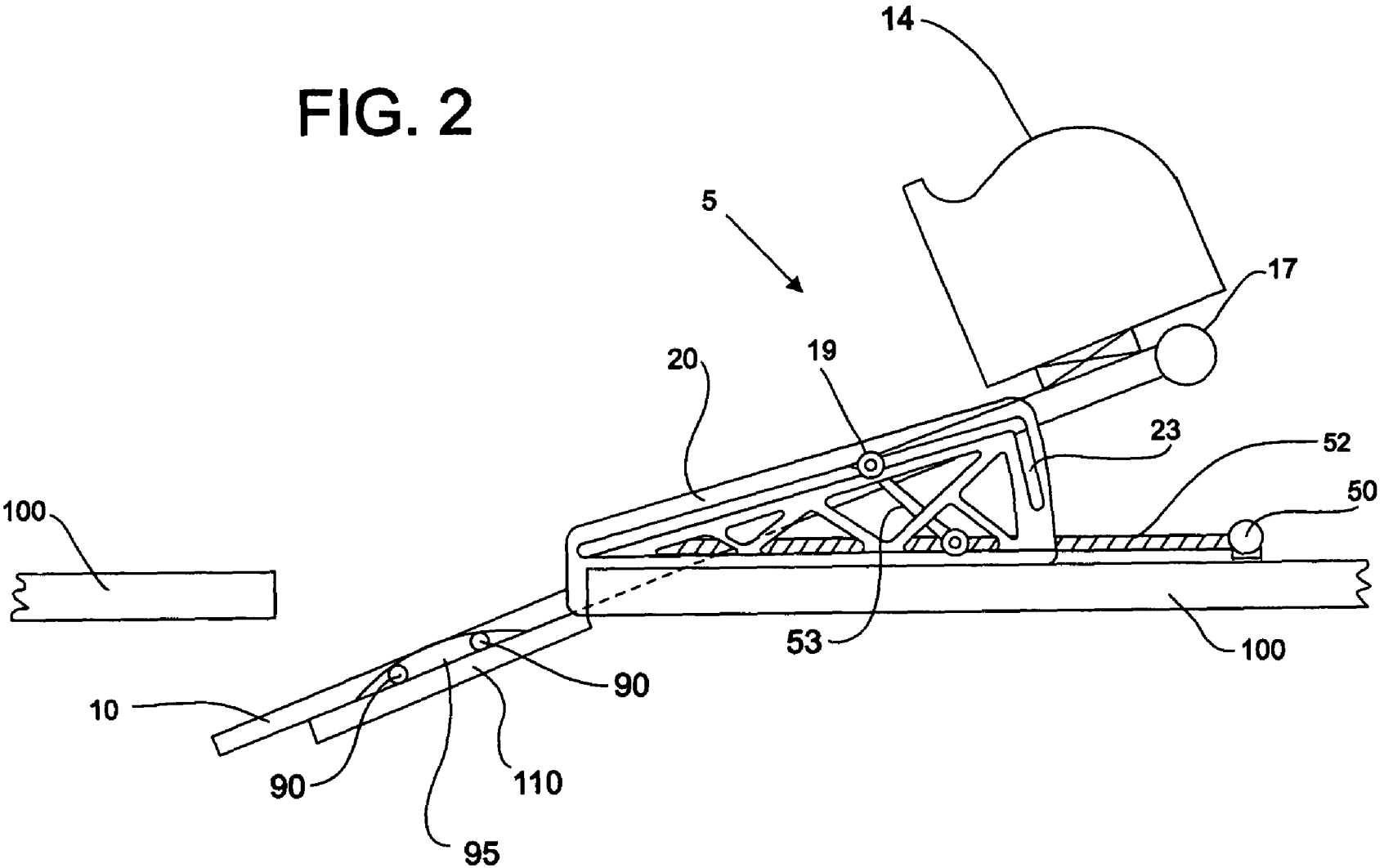
FIG. 2 shows a partial retracted side view of an embodiment of the current invention.

FIG. 2 shows the lift apparatus (5) in a partially retracted position. The lift apparatus (5) could be in the process of being extended to the floor for use or being retracted from the floor (200) (not shown in this view) to a fully retracted storage position above the ceiling (100). During the process of deployment of the lift rail (10), either to an in-use position or to a storage position, the lift platform (14) will ordinarily be fully retracted and in proximity to the lift motor (17). In FIG. 2, the control arm (53) is moving on the guide roller (19) in positioning guide slot (23) and is positioned approximately midway along the positioning acme drive (52) and is also approximately midway along the positioning guide slot (23) on the positioning guide (20). The trap door (110) is shown in a partially retracted position. The lift trolley (95) is shown on top of the trap door (110). The controlled rotational bearings (90) are also shown in this view. The controlled rotational bearings (90) secure the purpose of additionally providing guidance and control to the lift rail (10) during the deployment or retraction procedure.

Figure 3:
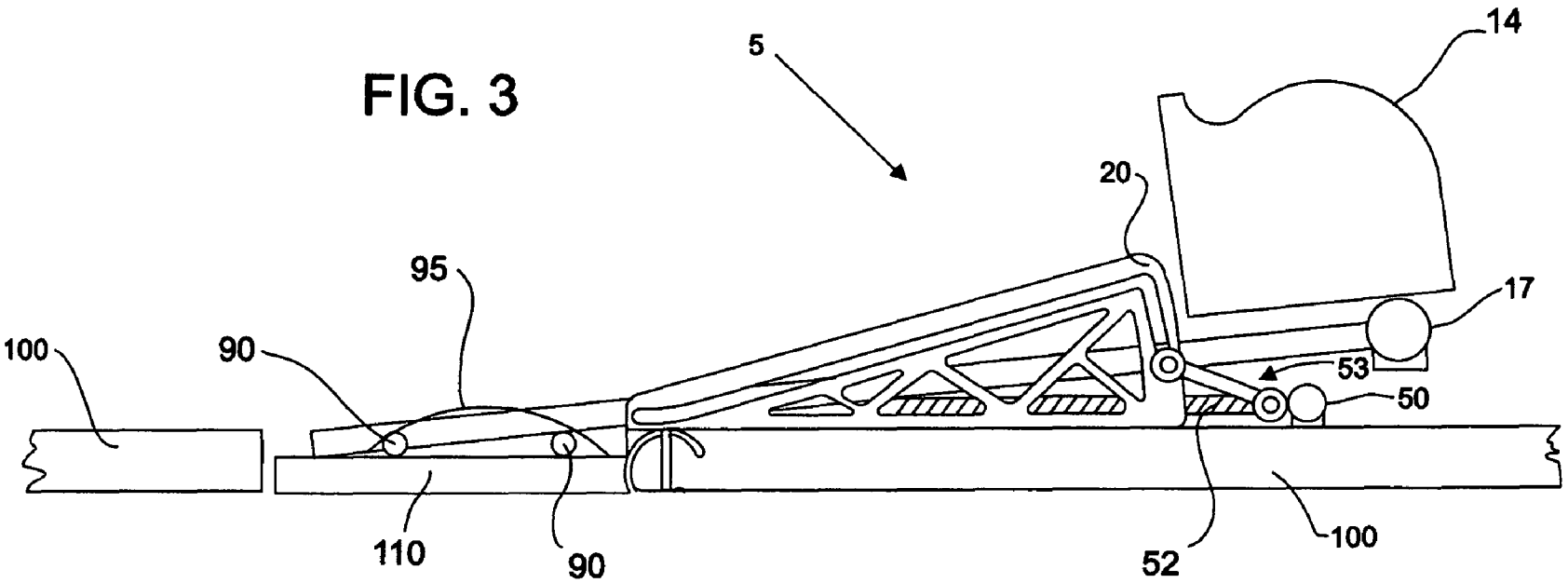
FIG. 3 shows a side view of an embodiment of the current invention retracted in a storage position.

FIG. 3 shows the lift apparatus (5) retracted on the positioning guide (20). The ceiling door (110) is closed. The lift platform (14) is on the lift rail (10) in proximity to the lift rail motor (17). The ceiling door (110) is shown closed. The lift rail (10) is positioned within the lift trolley guide (95). The control arm (53) has moved along the positioning acme drive (52). The positioning slot end of the control arm (53) is in the fully retracted position in the control guide (20), bringing the lift rail (10) to an approximate horizontal position. To deploy the lift apparatus (5), the positioning acme drive (52) will reverse direction of rotation moving the control arm (53) away from the positioning motor (50), first forcing the slot end of the control arm (53) up and along the guide slot (23) and thereby tilting the lift rail (10) and forcing open the trap door (110). As the positioning acme drive (52) continues to rotate, the lift rail (10) will be guided down the positioning guide slot (23) to where it ultimately reaches the fully deployed position as shown in FIG. 1. In the fully deployed position, the lift rail (10) will be perpendicular to the floor (200) (not seen in this view) with its weight supported by the floor (200). When the positioning arm drive (52) reverses direction, this movement will be reversed pulling the lift rail (10) back into the fully retracted position, as seen in FIG. 3. It is anticipated that both the lift rail motor (17) and the positioning motor (50) will be operated by a radio actuated remote. Consequently, a user would first actuate the positioning motor (50) to lower the lift rail (10) into position on the floor. The user would then actuate the lift rail motor (17) to raise and lower the lift platform (14) as required. A radio actuated remote could also have other functions. It could have a touch screen or a menu to allow one to record dates and times of use and also record what was stored and removed from the storage space accessed by the lift apparatus (5). The remote control could search using dates, times, or the name of stored items and display the results.

Figure 4:
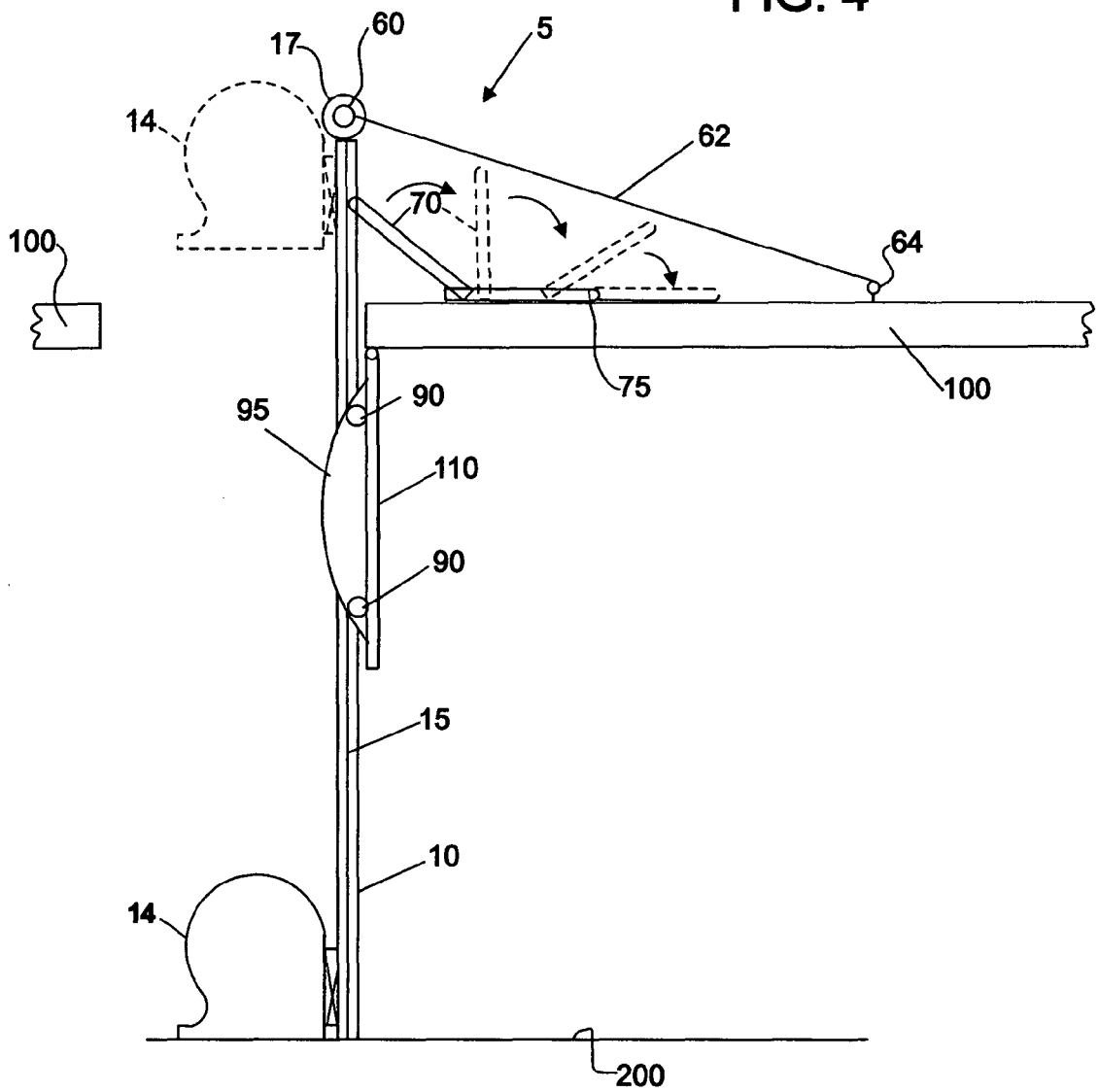
FIG. 4 shows a first alternative embodiment of the current invention.

FIG. 4 shows an alternative embodiment of the current invention. This embodiment's construction is simplified to reduce the overall complexity and cost of the lift apparatus (5) but leaving unchanged the functional part of the lift apparatus (5) including the lift rail (10), the lift platform (14), the acme screw drive (15), and the lift motor (17). Ordinarily, the lift rail motor (17) will use direct current, as will all the motors used in all embodiments of the lift apparatus (5). A direct current motor may use a battery back up so that the lift apparatus (5) will still be operable even when the alternating current supplied to the house through the power grid may be interrupted due to storms or for other reasons. In the alternative embodiment shown in FIG. 4, the positioning guide (20), the accompanying positioning acme drive (52), and the positioning motor (50) are no longer used and are deleted from this embodiment. In this embodiment the lift motor (17) will be equipped with a clutch (not shown) which will provide not only a rotary motion for the acme drive (15) but also for a winch (60) which is connected by a cable (62) to an anchor (64). The lift rail (10) is connected to a rotary arm (70) which is mounted for rotary and sliding motion on a guide platform (75). (Shown in more detail in FIG. 4A.) It is anticipated that the lift motor (17) and the accompanying clutch can be controlled by a remote radio actuated control. A user may use the remote control (not shown) to raise and lower the lift platform (14). When it is desired to store the lift apparatus (5), the user would actuate the clutch in the lift motor (17) to begin to use the winch (60) to begin to coil the cable (62) on the winch (60) which would have the effect of tilting and pulling the lift rail (10) toward the anchor point (64). The rotary arm (70) along with the guide platform (75) makes sure the lift rail (10) stays in position. Controlled rotational bearings (90) are mounted on the ceiling door (110) in the lift control trolley (95) to serve two functions. First, they guide the lift rail (10) as it is being raised and lowered into position. Second, the controlled rotational bearings (90) are designed to impede movement in one direction while freely allow any movement in another direction. Here, the utility of the controlled rotational bearings (90) is to control the deployment of the lift rail (10) from the ceiling to the floor. For some reason if the cable (62) broke as the lift rail (10) was in the process of being deployed, the controlled rotational bearings (90) would stop the lift rail (10) from suddenly falling to the floor (200) possibly damaging the floor (200) or injuring a user. The controlled rotational bearings (90) are positioned so that they impede the motion of the lift rail (10) toward the floor (200) but allow the lift rail (10) to be readily raised from the floor (200) into the storage position in the ceiling (100). The embodiment shown in FIG. 4 functions the same as the embodiment shown in FIGS. 1-3 but dispenses with the need for an extra positioning motor, positioning guide, and positioning acme drive. This embodiment still uses an electric motor to power the deployment from a storage position in the ceiling (100) to an in-use position resting on the floor (200) and back to a storage position, but this embodiment can be built with less expense since only one electric motor, the lift drive motor (17), is required.

Figure 4A:
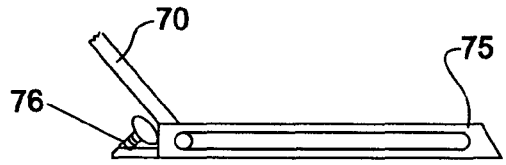
FIG. 4A is a detail view of a portion of the first alternative embodiment.

FIG. 4A shows the guide platform (75) in more detail. In FIG. 4A the guide platform (75) is seen from the side. There is a guide platform slot (77) in the guide platform (75). A rotary arm (70) is mounted within the guide platform slot (77) for slidable and rotatable movement. At one end of the guide platform (75) is a glide platform spring mounted bumper (79). This prevents the control arm (70) excessive rotation or movement while providing a fail-safe so that the lift rail (10) will not rotate beyond a perpendicular orientation to the floor (200) (not seen). Along with the controlled rotational bearings (90), this bumper (79) also helps control the deployment of the lift rail (10) to prevent uncontrolled movement of the lift rail (10) to the floor (200).

FIG. 5 discloses another embodiment of the lift apparatus (5). As with the embodiment disclosed in FIG. 4 and the embodiments disclosed in FIGS. 1-3, the basic functioning of the lift apparatus (5) remains the same. The lift rail (10), uses an acme screw drive (15) powered by a lift rail motor (17). The lift rail (10) folds down from its storage position within the ceiling or attic area to extend and rest upon the floor (200). In the embodiment disclosed in FIG. 5, the deployment of the lift rail (10) from its storage position within the ceiling to its functional position resting on the floor (200) is accomplished manually, although with some mechanical assistance. The ceiling trap door (110) connected to a cord (112). The lift rail (10) is shown in dotted lines in the storage position and in solid lines in the extended position for use. The user would grasp the ceiling trap door (110) by the cord (112) and pull it downward to begin to open the trap door (110). Many expedients are available at this point to deploy the lift rail (10) from its storage position to its in-use position resting on the floor (200). Here, there is a spring actuated cord (300) on a spring actuated coil (310). The spring actuated cord (300) extends as the lift rail (10) deploys but this extension is resisted by the spring coil (310). The spring coil (310) tends to prevent the lift rail (10) from precipitously falling under the force of gravity. The ceiling trap door (110) has the lift control trolley (95) with the controlled rotational bearings (90) to allow for a controlled deployment of the lift rail (10) from its storage position in the ceiling (100). The lift control trolley (95) also tends to more smoothly and accurately guide the lift rail (10) during deployment. In the embodiment of the lift apparatus (5) shown in FIG. 5, the deployment of the lift rail (10) is accomplished by a user. The controlled rotational bearings (90), the lift trolley (95) and the spring actuated cord (300) and the spring actuated coil (310) all provide a fail safe mechanism to prevent unexpectedly fast or dangerous deployments of the lift rail (10) and also to provide a mechanical advantage to a user to require less strength from a user to alternately deploy the lift rail (10) to its resting position on the floor (200) or to its storage position in the ceiling (100).

FIG. 5A shows the lift trolley (95) in more detail. The lift rail (10) moves along the controlled rotational bearings (90). The controlled rotational bearings (90) allow the lift rail (10) to move freely from the deployed position to the storage position, but only allow a controlled deployment from the storage position to the deployed position. Shown in FIG. 5A, is a lift trolley spring mounted bumper (96) designed to resist downward movement of the lift rail (10). A bumper stop (not shown) can be affixed to the lift rail (10) at an appropriate position so that just as the lift rail (10) is approaching the fully perpendicular position to the floor (200), the trolley bumper (96) stops the lift rail (10) from "over deployment" to prevent the lift rail from crashing into the floor (200). The lift rail trolley (95), the controlled rotational bearings (90), and the lift trolley bumper (96) are all mechanisms to assure controlled appropriate deployment of the lift rail (10) from its storage position seen in the dotted lines in FIG. 5 to its deployment position shown in the solid lines in FIG. 5. The lift rail trolley (95) and the accompanying mechanisms may be used in all embodiments, but would have their greatest application in the embodiment shown in FIG. 5 where the deployment of the lift rail (10) is done mechanically by a user with little assistance from winches, acme drives and the like.

I claim:

1. An automatic floor to ceiling and ceiling to floor lift apparatus comprising:

(a) a fixed rail of a predetermined length;

(b) means for deploying said fixed rail to and from a storage position on a ceiling to a vertical operating position with a first floor end of said fixed rail supported by a floor below said ceiling;

(c) a movable lift platform mounted on said fixed rail;

(d) means for powering motion of said lift platform along at least a portion of a lengthwise dimension of said fixed rail;

whereby said lift apparatus may be stored on a ceiling, then extended to rest on and be supported by a floor of a room below the ceiling, and the movable lift platform can be used to move objects along a portion of the lengthwise dimension of said fixed rail and then restored on said ceiling.

2. An automatic floor to ceiling and ceiling to floor lift apparatus of claim 1 wherein said ceiling defines an attic floor of an attic space above said room and said fixed rail of predetermined length is mounted on said attic floor above a room whereby said fixed rail is positioned in a storage position in the attic space on said attic floor and fixed rail is out of sight when in said storage position to an occupant of said room.

3. An automatic floor to ceiling and ceiling to floor lift apparatus of claim 2 wherein said means for powering motion of said lift platform comprises, at least in part, a lift electric motor to drive a lift screw drive in said fixed rail, said lift electric motor rotates said lift screw drive to raise and lower said lift platform along said lift screw drive in said fixed rail.

4. An automatic floor to ceiling and ceiling to floor lift apparatus of claim 3 wherein said means for deploying comprises a deployment electric motor to drive a deployment screw drive, said deployment electric motor rotates said deployment screw drive to move said fixed rail along a positioning guide from a storage position in said attic to an operating position where said lift rail is resting on and supported by a floor of a room below said ceiling and said attic.

5. An automatic floor to ceiling and ceiling to floor lift apparatus of claim 4 wherein said lift electric motor further comprises a lift electronic controller so that said lift electric motor's operation is controlled by said electronic controller.

6. An automatic floor to ceiling and ceiling to floor lift apparatus of claim 5 wherein said deployment electric motor further comprises a deployment electronic controller so that said deployment electric motor's operation is controlled by said electronic controller.

7. An automatic floor to ceiling and ceiling to floor lift apparatus of claim 6 wherein said lift and deployment electronic controller further comprises remote wireless means for operating said lift and deployment electronic controller.

8. An automatic floor to ceiling and ceiling to floor lift apparatus of claim 7 wherein said remote wireless means further comprises electronic memory wherein said remote wireless means may record, search, and display data so that an inventory of items stored in said attic may be made.

9. An automatic floor to ceiling and ceiling to floor lift apparatus of claim 3 wherein said means for deploying comprises a deployment winch powered by said lift electric motor, said deployment winch employing a cable attached to an anchor in said attic floor whereby said winch retracts said cable to pull said lift rail toward said anchor on said attic floor to move said lift apparatus to a storage position, and said winch extends said cable to move said lift rail to an operating position where said lift rail rests on and is supported by a floor of a room below said ceiling.

10. An automatic floor to ceiling and ceiling to floor lift apparatus of claim 9 further comprising a trap door in said attic floor, on said trap door a lift apparatus trolley, said lift rail slidably mounted on said lift apparatus trolley by controlled rotational bearings to control deployment of said lift rail on said lift apparatus trolley to an operating position on a floor in room below said ceiling.

11. An automatic floor to ceiling and ceiling to floor lift apparatus of claim 10 wherein said lift electric motor further comprises a lift electronic controller so that said lift electric motor and said deployment winch are controlled by said electronic controller.

12. An automatic floor to ceiling and ceiling to floor lift apparatus of claim 11 wherein said electronic controller further comprises remote wireless means for operating said electronic controller.

13. An automatic floor to ceiling and ceiling to floor lift apparatus of claim 12 wherein said remote wireless means further comprises electronic memory wherein said remote wireless means may record and display data so that an inventory of items stored in said attic may be made.

14. An automatic floor to ceiling and ceiling to floor lift apparatus of claim 3 wherein said means for deploying comprises a trap door in the attic floor; on the door a lift apparatus trolley, lift rail slidably mounted on said lift apparatus trolley by controlled rotational bearings to control deployment of said lift rail on said apparatus trolley with operating position on a floor in a room below said ceiling.

15. An automatic floor to ceiling and ceiling to floor lift apparatus of claim 14 further comprising means for manually opening said trap door in said attic floor while said lift rail deploys from a storage position on said lift apparatus trolley by controlled rotational bearings in operational position on the floor in a room below said ceiling as the trap door is manually opened.

16. An automatic floor to ceiling and ceiling to floor lift apparatus of claim 15 wherein said lift electric motor further comprises a lift electronic controller so that said lift electric motor's operation is controlled by said electronic controller.

17. An automatic floor to ceiling and ceiling to floor lift apparatus of claim 16 wherein said lift electronic controller further comprises remote wireless means for operating said lift electronic controller.

18. An automatic floor to ceiling and ceiling to floor lift apparatus of claim 17 wherein said remote wireless means further comprises electronic memory wherein said remote wireless means may record and display data so that an inventory of items stored in said attic may be made.

* * * * *